US007950920B2

(12) United States Patent
Vale

(10) Patent No.: US 7,950,920 B2
(45) Date of Patent: May 31, 2011

(54) COMBUSTION DEVICE

(76) Inventor: Colin Alfred Vale, Cape Town (ZA)

( * ) Notice: Subject to any disclaimer, the term of this patent is extended or adjusted under 35 U.S.C. 154(b) by 973 days.

(21) Appl. No.: 11/815,097

(22) PCT Filed: Dec. 21, 2005

(86) PCT No.: PCT/IB2005/003855

§ 371 (c)(1),
(2), (4) Date: Jul. 30, 2007

(87) PCT Pub. No.: WO2006/079881

PCT Pub. Date: Aug. 3, 2006

(65) Prior Publication Data

US 2009/0136881 A1 May 28, 2009

(30) Foreign Application Priority Data

Jan. 31, 2005 (ZA) ..... 2005/0867

(51) Int. Cl.

| | |
|---|---|
| ***F23D 11/22*** | (2006.01) |
| *F23D 11/24* | (2006.01) |
| *F23D 11/36* | (2006.01) |
| *F23D 11/44* | (2006.01) |

(52) U.S. Cl. ..... 431/88; 126/4; 126/43; 126/44; 137/38; 137/43; 137/67; 137/206; 137/581; 220/1.6; 220/567.2; 220/720; 222/96; 222/397; 431/12; 431/38; 431/100; 431/207; 431/344

(58) Field of Classification Search ..... 431/11, 431/12, 36–41, 88, 100, 108, 110, 111, 113, 431/207, 242, 243, 247, 248, 344; 126/4, 126/30, 38, 43, 44; 137/38, 43, 67, 156, 206, 581; 220/1.6, 720, 723, 495.01, 495.05, 495.06, 567.2; 383/30; 417/394; 222/95, 96, 397, 399; *F23D 11/22, 11/24, 11/36, 11/44*

See application file for complete search history.

(56) References Cited

U.S. PATENT DOCUMENTS

| | | | | |
|---|---|---|---|---|
| 257,402 | A * | 5/1882 | Staehlen | 137/580 |
| 332,650 | A * | 12/1885 | Fahnehjelm | 431/347 |
| 1,022,048 | A * | 4/1912 | von Post | 431/36 |
| 1,127,455 | A * | 2/1915 | Krauss | 431/61 |
| 1,554,747 | A * | 9/1925 | Meissner | 431/231 |

(Continued)

FOREIGN PATENT DOCUMENTS

| | | |
|---|---|---|
| EP | 1 348 910 | 1/2003 |

(Continued)

*Primary Examiner* — Steven B McAllister
*Assistant Examiner* — Daniel E Namay
(74) *Attorney, Agent, or Firm* — ARC IP Law, PC; Joseph J. Mayo

(57) ABSTRACT

A combustion device in the form of a paraffin stove (10) comprises a fuel reservoir (12), a burner (14), stand pipe (16) which extends between the reservoir (12) and the burner (14) and a stove top (18). The reservoir (12) comprises a rigid, air-tight outer container (22) and a deformable bladder (25) for holding paraffin (27) which is located within the container (22). The bladder has an outlet (44) which is connected to the stand pipe (16). A conduit (51) which can be connected to a source of compressed air is connected to the container (22) for pressurizing the container (22) to exert a force on the bladder (25) sufficient to cause the paraffin to be delivered to the burner (14) where it is ignited to produce a flame.

9 Claims, 5 Drawing Sheets

U.S. PATENT DOCUMENTS

| | | | | | |
|---|---|---|---|---|---|
| 1,718,473 | A | * | 6/1929 | McCutchen | 431/231 |
| 2,025,837 | A | * | 12/1935 | Tullis | 431/37 |
| 2,206,949 | A | * | 7/1940 | Giles | 137/244 |
| 2,235,946 | A | * | 3/1941 | Reilly | 222/209 |
| 3,169,519 | A | * | 2/1965 | Aizawa et al. | 126/96 |
| 3,504,827 | A | | 4/1970 | Larson | |
| 3,768,696 | A | * | 10/1973 | Laerdal | 222/29 |
| 3,777,479 | A | * | 12/1973 | Hagen | 60/39.25 |
| 3,850,372 | A | * | 11/1974 | Finnstrand | 239/123 |
| 4,096,995 | A | * | 6/1978 | Klomp | 239/94 |
| 4,827,714 | A | * | 5/1989 | Miles | 60/764 |
| 4,867,344 | A | * | 9/1989 | Bitterly | 222/94 |
| 5,277,336 | A | * | 1/1994 | Youel | 222/105 |
| 5,469,706 | A | | 11/1995 | Hoya | |
| 5,553,740 | A | * | 9/1996 | King et al. | 222/1 |
| 6,230,943 | B1 | * | 5/2001 | Miyamoto et al. | 222/394 |
| 6,527,150 | B2 | * | 3/2003 | Benoist | 222/402.1 |
| 7,168,426 | B1 | * | 1/2007 | Hsu | 126/40 |
| 2001/0032853 | A1 | * | 10/2001 | Kuehn et al. | 220/495.03 |
| 2007/0151987 | A1 | * | 7/2007 | Arghyris et al. | 222/386.5 |

FOREIGN PATENT DOCUMENTS

| | | | | |
|---|---|---|---|---|
| JP | 04324027 | A | * | 11/1992 |
| WO | WO 96/29543 | | | 9/1996 |

* cited by examiner

COMBUSTION DEVICE

FIELD OF INVENTION

This invention relates to a combustion device and to a method of combusting a liquid fuel using the combustion device.

BACKGROUND TO INVENTION

Liquid-fueled combustion devices such as paraffin stoves, heaters and lamps are used throughout the world, particularly in poor households. The area in which such paraffin field combustion devices is used is often cramped and in many instances, combustible materials are located in close proximity to the combustion device. Such combustion devices pose a fire risk when knocked over as fuel often tends to leak from such devices, which may be ignited by the burner.

It is an object of the present invention to provide a liquid-fueled combustion device which ameliorates the abovementioned problems with existing liquid-fueled combustion devices.

SUMMARY OF INVENTION

According to a first aspect of the invention there is provided a combustion device for combusting a liquid fuel, the combustion device including:

a fuel reservoir comprising a rigid, air-tight outer container defining an outlet opening for fuel and an inlet opening which can be connected to a source of pressurized fluid; and a deformable fluid-impervious membrane which is located within the outer container and which separates the fuel reservoir into a first chamber in which the fuel can be contained and a second chamber which can be pressurized by the pressurizing fluid for pressurizing the fuel within the first chamber;

a burner for burning the fuel, which is elevated above the fuel reservoir; and fuel supply means which extends between the outlet opening of the outer container and the burner for conveying fuel to the burner, the pressurized fluid exerting sufficient force on the membrane and thereby the fuel in the first chamber to cause the fuel to be conveyed along the fuel supply means to the burner.

In one embodiment of the invention, the membrane may be in the form of a bladder in which the fuel is contained and which defines an outlet which is connected to the outlet opening of the outer container, the first chamber being defined within the bladder and the second chamber being defined by a space between the bladder and the outer container.

The outlet of the bladder may be releasably connected to the outlet opening of the outer container, the outer container comprising two container parts which are releasably connected to one another thereby to permit the removal from and introduction of the bladder into the outer container when the container parts are disconnected.

In another embodiment of the invention, the membrane may be in the form of a sheet element which is secured along a peripheral edge thereof to the outer container thereby to define said first chamber above the sheet element and said second chamber below the sheet element.

The outer container of the fuel reservoir may have a base which is locatable on a ground surface, the base defining a discharge opening through which the pressurized fluid can be discharged from the reservoir and a pressure-release valve which is located within the discharge opening, the valve including a valve actuation member which is displaceable between a valve-closing position wherein the valve actuation member closes the discharge opening and a valve-opening position wherein the valve actuation member opens the discharge opening, the valve actuation member projecting from the base of the fuel reservoir such that it is acted upon by said ground surface which holds the valve actuation member in its valve-closing position, the valve including urging means which exerts a force on the valve actuation member for urging it into its valve-opening position, thereby causing the release of the pressurized fluid from the reservoir when the valve actuation member is lifted off the ground surface.

The fuel supply means may be in the form of a stand pipe which extends between the fuel reservoir and the burner.

The combustion device may include a pressurized fluid supply conduit which has a first connector at one end for connecting the fluid supply conduit to the inlet opening of the outer container and a second connector at the other end thereof for connecting the fluid supply conduit to said source of pressurized fluid.

The fluid supply conduit may include a pressure-release valve which is operable to discharge pressurized fluid from the fluid supply conduit when a predetermined threshold pressure is achieved, in use.

The combustion device may be in the form of a stove which includes support means which is disposed above the burner and on which a cooking vessel can be supported, in use.

The invention extends to the bladder as defined and described hereinabove.

According to a second aspect of the invention there is provided a method of combusting a liquid fuel, which includes:

providing a combustion device as defined hereinabove; and introducing a pressurized fluid into the second chamber at a pressure sufficient to exert a force on the membrane to cause the fuel within the first chamber to be conveyed along the fuel supply means to the burner.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DESCRIPTION OF PREFERRED EMBODIMENTS

Figure 1:
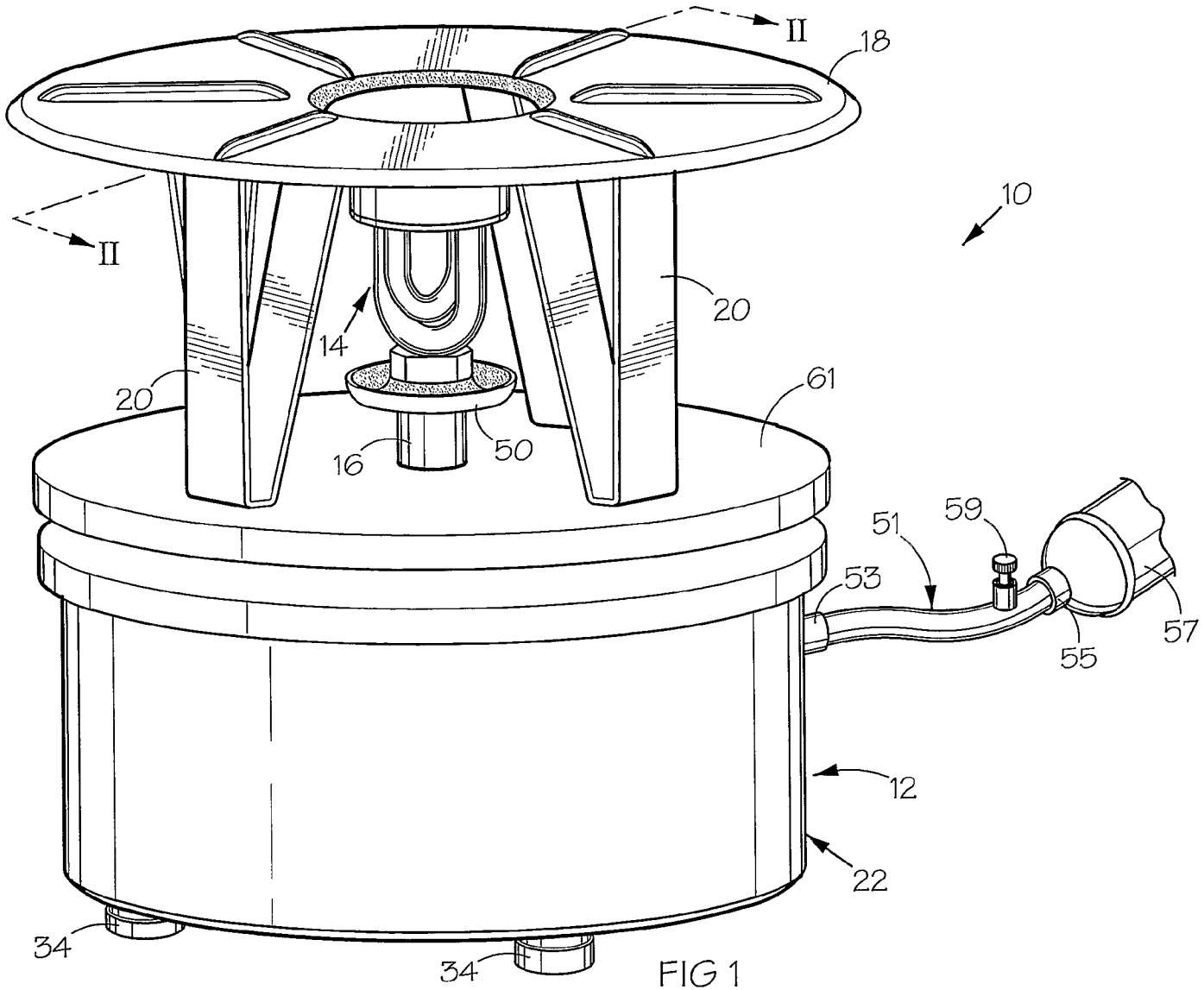
FIG. 1 shows a schematic perspective view of a combustion device in accordance with the invention.
Figure 2:
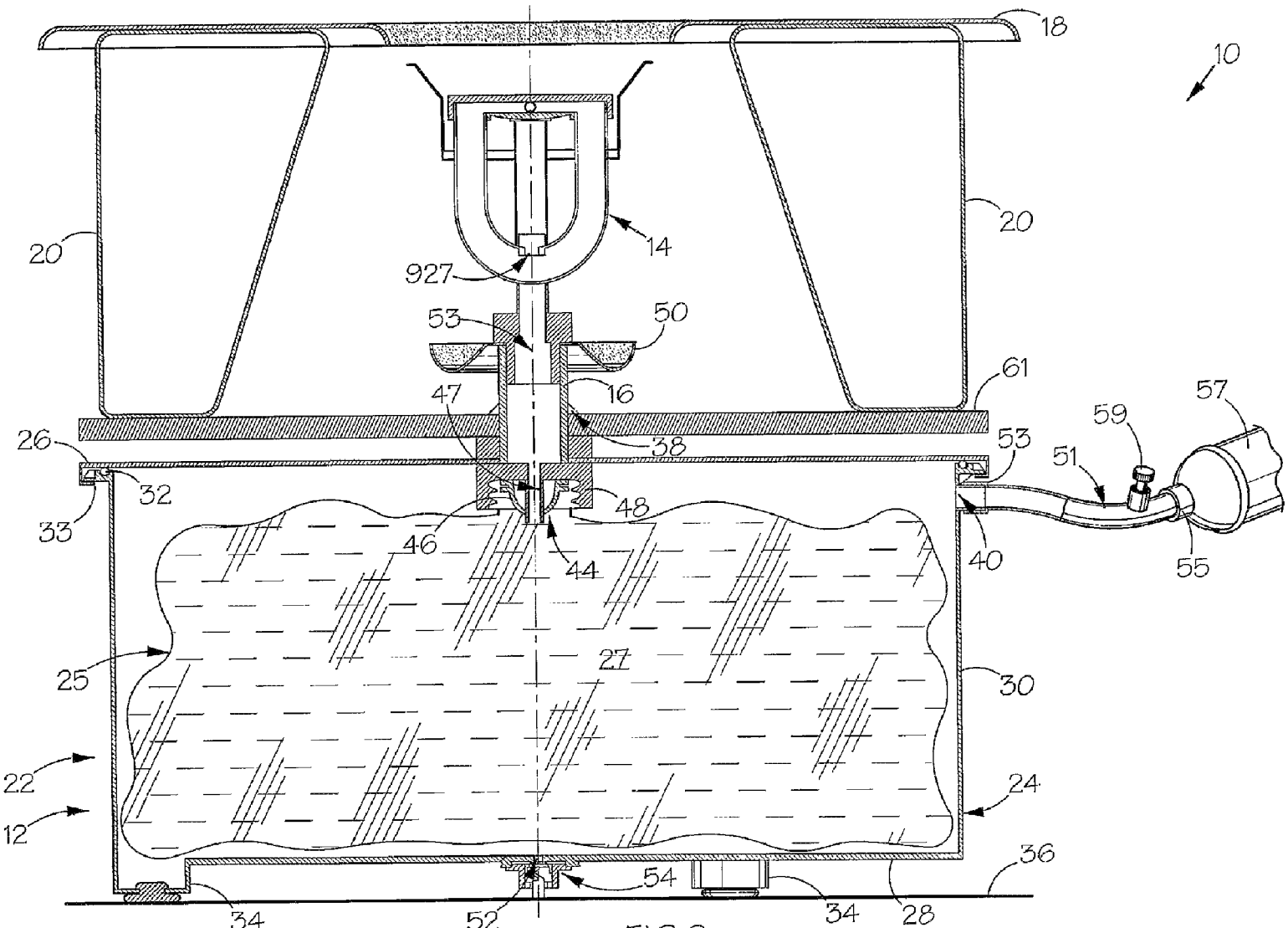
FIG. 2 shows a schematic sectional side view of the combustion device of FIG. 1, sectioned along section line II-II of FIG. 1.

With reference to FIGS. 1 to 4 of the drawings, a combustion device in the form of a paraffin stove is designated generally be the reference numeral 10. The stove 10 comprises, broadly, a fuel reservoir 12 for containing liquid paraffin, a burner 14 for burning the paraffin, fuel supply means in the form of a stand pipe 16 which extends between the fuel reservoir 12 and the burner 14 and a stove top 18 which is supported above the burner 14 by means of three legs 20.

The fuel reservoir 12 comprises a rigid, air-tight outer container 22 which comprises an open-topped receptacle 24 and a lid 26 which is releasably secured to the receptacle 24, and a fluid-impervious membrane in the form of a deformable bladder 25 for holding paraffin 27, which is located within the container 22. The receptacle 24 comprises a base wall 28 and a cylindrical side wall 30 which extends upwardly from the base wall. A rubber o-ring 32 which is located in a groove provided therefor in a flange 33 at the rim of the receptacle 24, provides an air-tight seal between the lid 26 and the rim of the receptacle 24. The container 22 includes three feet 34 which are attached to an underside of the base wall 28 and on which the receptacle 24 can be supported on a flat ground surface 36. The lid 26 defines a central aperture 38 in which the stand pipe 16 is located. The side wall 30 of the receptacle 24 defines an inlet opening 40 which is operatively connected to a source of pressurized fluid such as compressed air. The bladder 25 defines an outlet opening 44 and has a connector 46 secured to the outlet opening 44. The connector 46 defines an external screw-thread and an internal passage 47 of reduced diameter through which paraffin can flow from the bladder.

The bladder thus defines a first chamber in which paraffin is contained, while a second chamber for compressed air is defined by the space between the bladder 25 and the outer container 22.

The stand pipe 16 has an internally screw-threaded bush 48 at a lower end thereof which is located within the container 22 and which abuts the underside of the lid 26. A seal is provided between the lid 26 and the bush 48. The connector 46 of the bladder 25 is screwed into the bush 48. An annular pre-heater cup 50 in which a pre-heater fuel such as methylated spirits can be heated for pre-heating the burner 14, is fixed to an upper end of the stand pipe 16.

The stand pipe 16 defines an internal passage 53 along which paraffin can flow from the fuel reservoir to the burner 14. The paraffin is vaporized in the burner and paraffin vapour issues from a burner orifice 927, which is ignited to produce a flame. The burner 14 is of a conventional type used with paraffin stoves and is thus not described in any further detail.

Being releasably secured to the receptacle 24, the lid 26 can be separated from the receptacle 24 thereby to permit the removal from and introduction of the bladder 25 into the outer container 22. This allows the bladder 25, when depleted of its paraffin, to be replaced by a similar bladder filled with paraffin.

Figure 3:
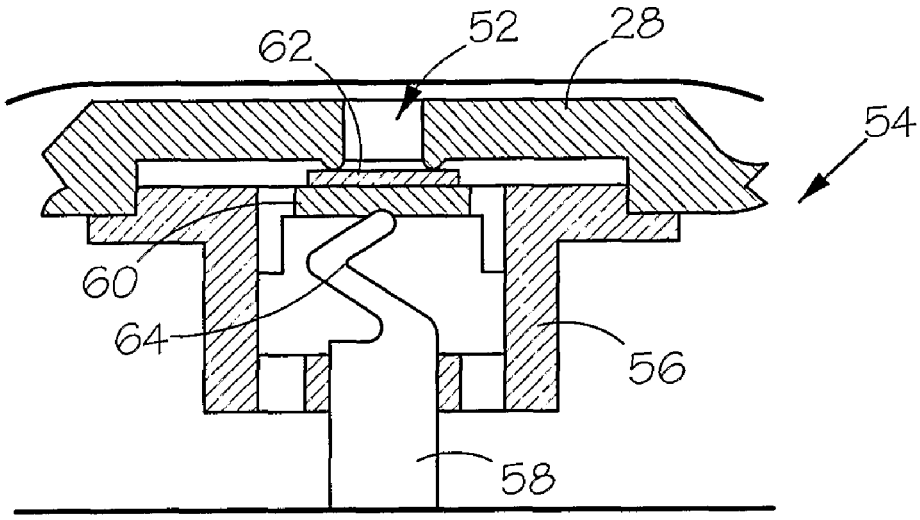
FIG. 3 shows a sectional side view of the pressure-release valve mounted in the base of the fuel reservoir of the combustion device of FIG. 1, in a closed condition.
Figure 4:
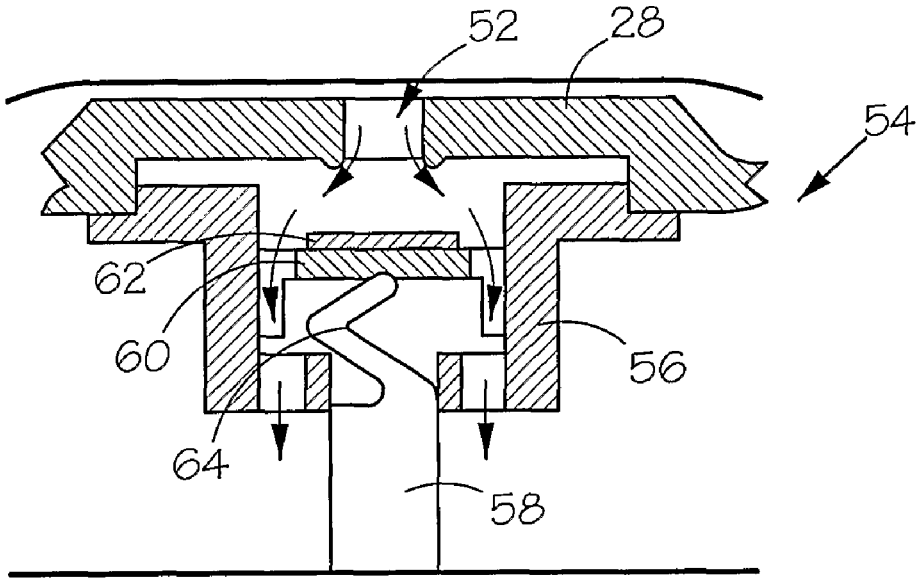
FIG. 4 shows a sectional side view of the pressure-release valve of FIG. 3, in an open condition.

The base wall 28 of the receptacle 24 of the fuel reservoir has a central discharge opening 52 through which compressed air can be discharged from the reservoir. The stove 10 includes a pressure-release valve 54 which is located within the discharge opening 52. The valve 54 includes a valve body 56, a valve actuation member in the form of an actuation pin 58, a disc 60 which carries a rubber disc-shaped seal 62, urging means in the form of a coil spring 64 which acts between the disc 60 and the pin 58. The actuation pin 58 is displaceable between a valve-closing position (as shown in FIG. 3) wherein the rubber seal closes off the discharge opening 52 and a valve opening position (as shown in FIG. 4) wherein the seal 62 is spaced from the discharge opening 52, thereby allowing compressed air to escape from the reservoir. The actuation pin 58 projects from the base wall 28 of the receptacle 24 such that it is acted upon by the ground surface 36 which holds the pin 58 in its valve-closing position. In its valve-closing position, the actuating pin holds the coil spring in compression so that when the fuel reservoir is lifted off the ground, for example, if the paraffin stove is knocked over, the spring urges the actuation pin 58 into its valve-opening position, thereby causing the release of compressed air from the reservoir.

The stove 10 includes a pressurized fluid supply conduit 51 which has a first connector 53 at one end for connecting the conduit to the inlet opening 40 of the outer container 22 and a second connector 55 at the other end thereof for connecting the conduit to the source of compressed air. The second connector 55 may include a conventional bicycle tyre valve to which a bicycle pump 57 or other hand-operated pump can be connected for pumping air into the outer container for pressurizing the bladder 25. A pressure regulator valve 59 is provided for regulating the pressure of compressed air delivered to the fuel reservoir.

The stove 10 includes a metal cover plate 61 which is fixedly connected to the stand pipe 16 and which is spaced above the lid 26 of the fuel reservoir. Lower ends of the legs 20 are connected to an upper side of the cover plate 61. The cover plate 61 prevents spilled fuel, liquids or food from falling onto the fuel reservoir. It also serves as a heat deflector and a heat sink to conduct heat that is conducted down the stand pipe 16 away from the bush 48 and the fuel reservoir.

In use, the second chamber surrounding the bladder 25 is pressurized with compressed air to a pressure wherein sufficient force is exerted on the bladder 25 and thereby the paraffin contained therein, to cause the paraffin to rise up the stand pipe 16 and to enter the burner 14 where it is vaporized and thereafter for the vaporized paraffin to issue from the orifice 27. If the stove 10 is knocked over, the base wall 28 lifts off the ground surface 36 causing the actuation pin 58 of the pressure-release valve 54 to be displaced into its valve-opening position, resulting in the discharge of compressed air from the second chamber. As the pressure is reduced in the second chamber, the force exerted by the compressed air on the bladder is removed, thereby shutting off the delivery of paraffin to the burner. This safety feature ensures that no paraffin is leaked from the stove after it is knocked over, which can be ignited.

Figure 5:
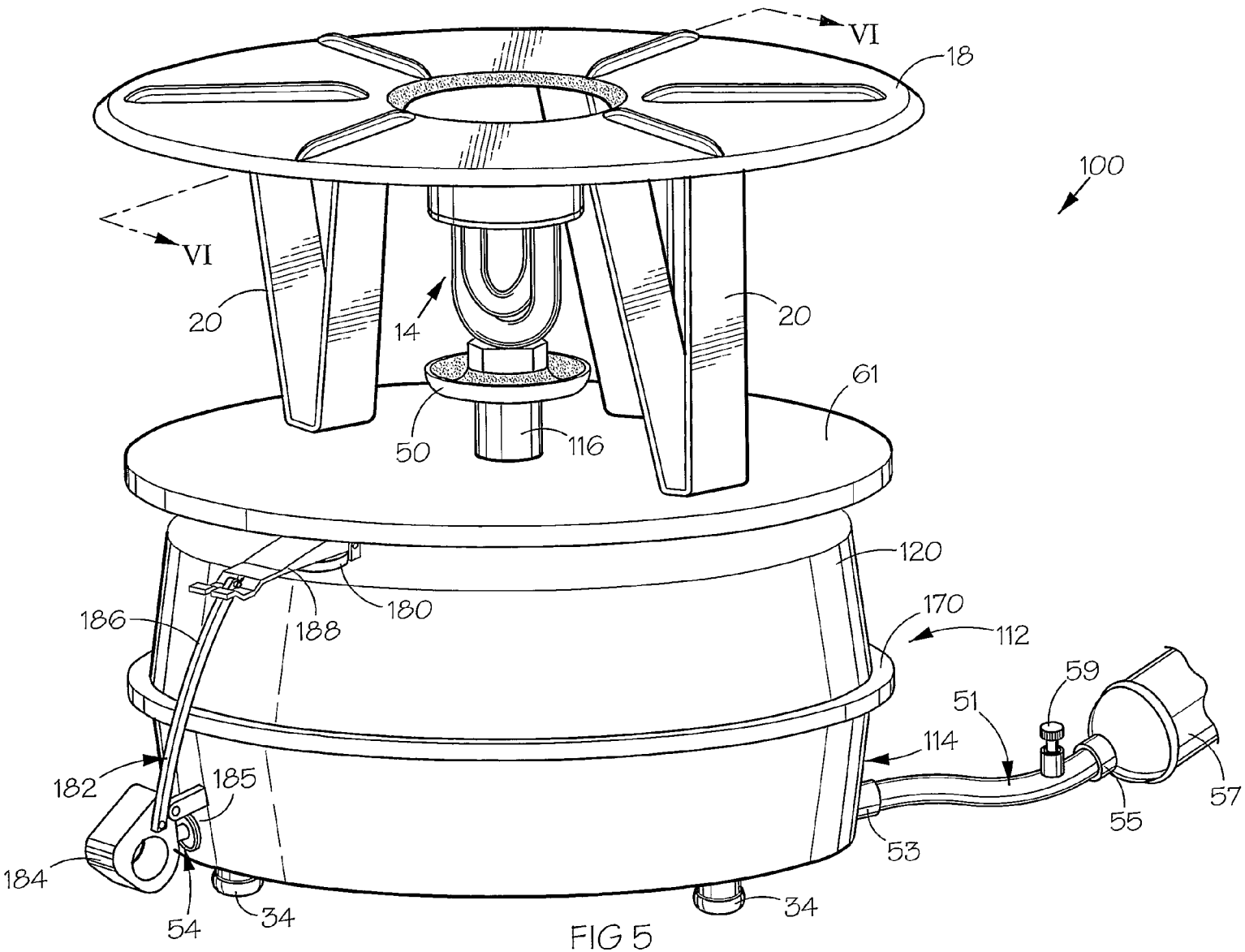
FIG. 5 shows a schematic perspective view of another embodiment of a combustion device in accordance with the invention.
Figure 6:
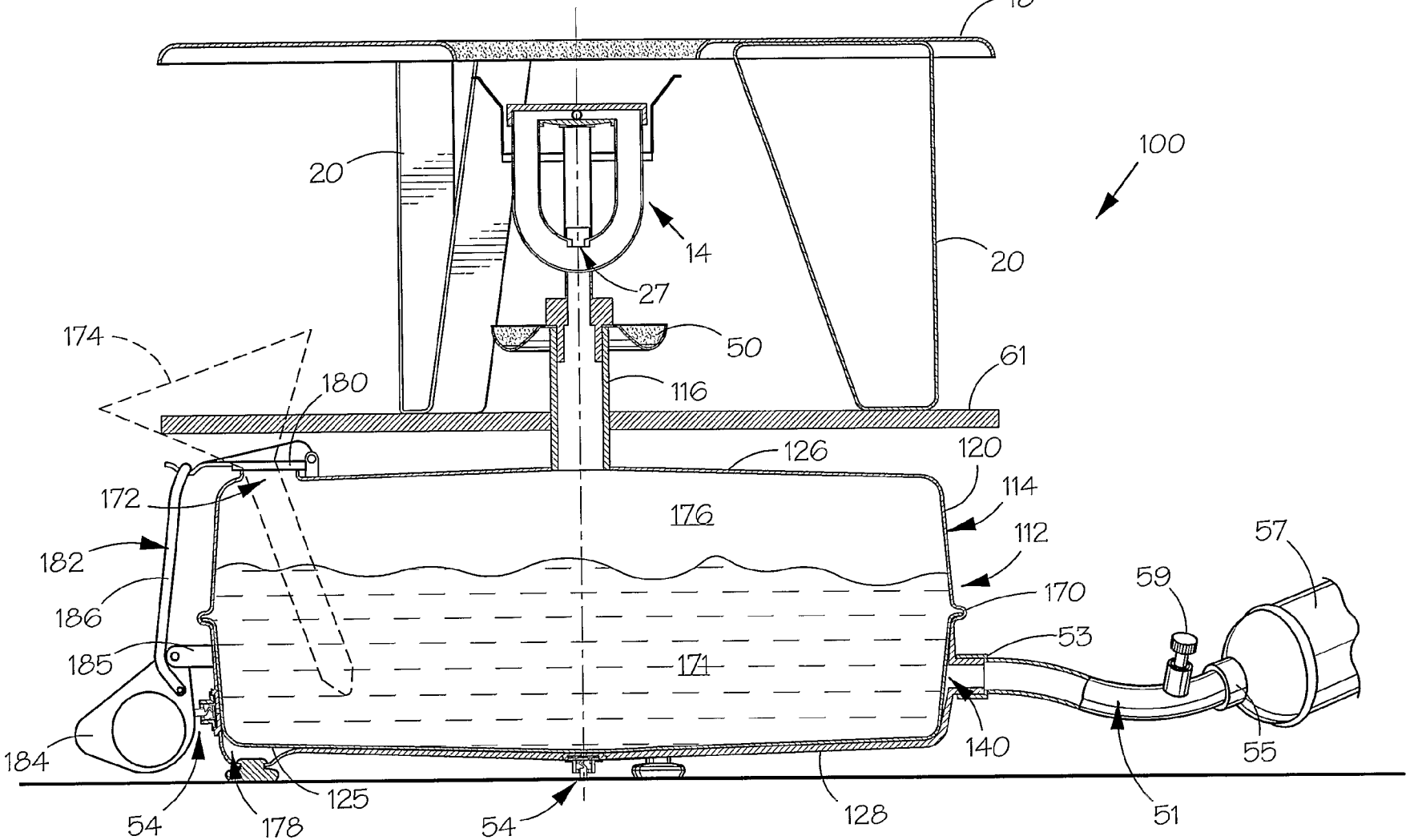
FIG. 6 shows a schematic sectional side view of the combustion device of FIG. 5, sectioned along section line VI-VI of FIG. 5.

With reference to FIGS. 5 and 6 of the drawings, another embodiment of a combustion device in accordance with the invention, is illustrated. The combustion device shown in FIGS. 5 and 6 is in the form of a paraffin stove 100. The paraffin stove 100 is similar to the paraffin stove 10 and as such, the same and/or similar reference numerals are used to designate the same and/or similar features. As for the stove 10, the stove 100 comprises a fuel reservoir 112 for containing liquid paraffin, a burner 14 for burning the paraffin, a stand pipe 116 which extends between the reservoir 112 and the burner 14 and a stove top 18 which is supported above the burner by means of three legs 20.

The fuel reservoir 112 comprises a rigid, air-tight outer container 114 which comprises a base wall 128, a top wall 126 and a substantially cylindrical side wall 120 which extends between the base wall and the top wall. The side wall 120 defines a peripheral groove formation 170. The top wall 126 defines a filler opening 172 through which liquid paraffin 171 can be introduced into the container 114 by means of a funnel 174 or the like. The fuel reservoir 112 includes a fluid-impervious deformable membrane in the form of a sheet element 125. A peripheral edge of the sheet element 125 is received within the groove 170 where the peripheral edge is secured to the side wall 120 in a fluid-tight manner. The sheet element 125 thus separates the outer container into a fluid-tight upper chamber 176 in which paraffin is contained and a fluid-tight lower chamber 178 into which compressed air is pumped, in use, for pressurizing the chamber 178.

As for the stove 10, the base wall 128 defines a discharge opening 52 in which a pressure-release valve 54 is located.

The outer container 114 defines an inlet opening 140 through which compressed air can enter the second chamber 178. As for the stove 10, the stove 100 includes a pressurized fluid supply conduit 51 which can be releasably connected to the inlet 140 of the container 114 at one end and at the other end thereof to a source of compressed air 57 such as a bicycle pump or the like.

The outer container 114 includes a cap 180 for securely closing the filler opening 172 and a locking mechanism 182 for releasably locking the cap 180 in a closed condition. The locking mechanism 182 includes a handle in the form of an eye 184 which is pivotally secured to a bracket 185 fixed to an outer side of the side wall 120 of the fuel reservoir. The locking mechanism further includes a lever 186 which is pivotally connected at a lower end thereof to the eye 184 and at an upper end thereof to an attachment bracket 188 which is secured to the cap 180. The locking mechanism 182 has an "over-centre" locking action so that in a locked position, a pulling force sufficient to overcome the locking action must be exerted on the eye 184.

As a safety feature which prevents the cap 180 from being opened while the stove 100 is being used, a discharge opening 52 is provided in the side wall 120 within pressure-release valve 54 is mounted to the side wall 120 to regulate the discharge of compressed air through the discharge opening 52. The actuator pin 58 of the pressure-release valve 54 is held in its valve-closing position by the eye 184, thereby preventing the discharge of air from the lower chamber 178 in the locked condition of the locking mechanism. When the eye 184 is pulled away from the side wall 120 when attempting to open the cap 180, the holding force on the pin 58 is removed causing it to be displaced into its valve-opening position resulting in the discharge of air from the chamber 178. This has the effect of removing the force exerted on the sheet element by the compressed air and as a result, shutting off of the supply of paraffin to the burner 14.

It will be appreciated that the exact configuration of the combustion device may vary considerably while still incorporating the essential features of the invention as described and defined hereinabove.

The invention claimed is:

1. A combustion device for combusting a liquid fuel, the combustion device including:

a fuel reservoir comprising a rigid, air-tight outer container defining an outlet opening for fuel and an inlet opening which can be connected to a source of pressurized fluid;

a deformable fluid-impervious membrane which is located within the outer container and which separates the fuel reservoir into a first chamber in which the fuel can be contained and a second chamber which can be pressurized by the pressurized fluid for pressurizing the fuel within the first chamber;

a burner for burning the fuel, which is elevated above the fuel reservoir; and fuel supply means which extends between the outlet opening of the outer container and the burner for conveying fuel to the burner, the pressurized fluid exerting sufficient force on the membrane and thereby the fuel in the first chamber to cause the fuel to be conveyed along the fuel supply means to the burner; and, wherein the rigid, air-tight outer container of the fuel reservoir has a base which is locatable on a ground surface, the base defining a discharge opening through which the pressurized fluid can be discharged from the reservoir and a pressure-release valve which is located within the discharge opening, the valve including a valve actuation member which is displaceable between a valve-closing position wherein the valve actuation member closes the discharge opening and a valve-opening position wherein the valve actuation member opens the discharge opening, the valve actuation member projecting from the base of the fuel reservoir such that it is acted upon by said ground surface which holds the valve actuation member in its valve-closing position, the valve including urging means which exerts a force on the valve actuation member for urging it into its valve-opening position, thereby causing the release of the pressurized fluid from the reservoir when the valve actuation member is lifted off the ground surface.

2. The combustion device as claimed in claim 1 wherein the membrane is in the form of a bladder in which the fuel is contained and which defines an outlet which is connected to the outlet opening of the outer container, the first chamber being defined within the bladder and the second chamber being defined by a space between the bladder and the outer container.

3. The combustion device as claimed in claim 2 wherein the outlet of the bladder is releasably connected to the outlet opening of the outer container, the outer container comprising two container parts which are releasably connected to one another thereby to permit the removal from and introduction of the bladder into the outer container when the container parts are disconnected.

4. The combustion device as claimed in claim 1 wherein the membrane is in the form of a sheet element which is secured along a peripheral edge thereof to the outer container thereby to define said first chamber above the sheet element and said second chamber below the sheet element.

5. The combustion device as claimed in claim 1 wherein the fuel supply means is in the form of a stand pipe which extends between the fuel reservoir and the burner.

6. The combustion device as claimed in claim 1 which includes a pressurized fluid supply conduit which has a first connector at one end for connecting the fluid supply conduit to the inlet opening of the outer container and a second connector at the other end thereof for connecting the fluid supply conduit to said source of pressurized fluid.

7. The combustion device as claimed in claim 6 wherein the fluid supply conduit includes a pressure-release valve which is operable to discharge pressurized fluid from the fluid supply conduit when a predetermined threshold pressure is achieved, in use.

8. The combustion device as claimed in claim 1 wherein the combustion device is in the form of a stove which includes support means which is disposed above the burner and on which a cooking vessel can be supported, in use.

9. A method of combusting a liquid fuel, which includes:

providing a combustion device as claimed in claim 1; and introducing a pressurized fluid into the second chamber at a pressure sufficient to exert a force on the membrane to cause the fuel within the first chamber to be conveyed along the fuel supply means to the burner.

* * * * *